US007351012B2

(12) United States Patent
Desmeules

(10) Patent No.: US 7,351,012 B2
(45) Date of Patent: Apr. 1, 2008

(54) ROTATIONAL DRIVE APPARATUS FOR SCREW PILINGS

(75) Inventor: Norbert Desmeules, Montreal (CA)

(73) Assignee: 9031-1671 Quebec Inc., Montreal, Quebec (CA)

( * ) Notice: Subject to any disclaimer, the term of this patent is extended or adjusted under 35 U.S.C. 154(b) by 113 days.

(21) Appl. No.: 11/119,698

(22) Filed: May 3, 2005

(65) Prior Publication Data

US 2006/0251478 A1 Nov. 9, 2006

(51) Int. Cl.
*E02D 7/22* (2006.01)

(52) U.S. Cl. ..... 405/232; 405/252.1; 173/215; 173/216

(58) Field of Classification Search ..... 175/19, 175/162, 203; 405/232, 252.1, 244, 253; 173/213, 215, 216, 217, 218, 145, 147, 164
See application file for complete search history.

(56) References Cited

U.S. PATENT DOCUMENTS 3,367,426 A * 2/1968 Laverty ..... 173/21
4,601,348 A * 7/1986 Cox ..... 173/25
5,066,168 A 11/1991 Holdeman
5,350,027 A * 9/1994 Mauch et al. ..... 173/216
5,363,925 A * 11/1994 Gallagher ..... 173/186
5,598,893 A * 2/1997 Carlson ..... 173/216
5,707,180 A 1/1998 Vickars et al.

FOREIGN PATENT DOCUMENTS

JP 63223217 A * 9/1988
JP 63223218 A * 9/1988

* cited by examiner

*Primary Examiner*—Sunil Singh
(74) *Attorney, Agent, or Firm*—Ogilvy Renault LLP; Guy J. Houle

(57) ABSTRACT

A rotational drive apparatus for screw pilings is described. The apparatus comprises a housing having a cylindrical pipe coupling adapted to receive a shaft of a screw piling therethrough. A detachable connecting element secures the coupling to the shaft at different positions along the shaft. A rotational drive is provided within the housing for imparting rotation to the coupling. An elongated rod is secured to the housing and is held by a user person whereby to immobilize the housing wherein to permit the rotational drive to transmit a drive force to the coupling to rotate the shaft of a screw piling.

8 Claims, 5 Drawing Sheets

ROTATIONAL DRIVE APPARATUS FOR SCREW PILINGS

TECHNICAL FIELD

The present invention relates to a rotational drive apparatus for screw pilings and particularly to an apparatus which is transportable and which imparts a rotational drive to a coupling secured to the shaft of a piling. The apparatus is immobilized by a user person by the use of an elongated rod secured to the housing of the apparatus.

BACKGROUND ART

Screw pilings are known which comprise a shaft having a helix secured at a lower end thereof whereby to drive the piling into the ground when the shaft thereof is rotated in a clockwise direction. To impart a rotational drive to such shafts, heavy machinery is used whereby to attach a rotational drive to the top end of the shaft of the piling. An example of this system is described in U.S. Pat. No. 5,066,168. A disadvantage of such system is that the apparatus is large, is expensive to use and its use is restricted to open space areas. It cannot be utilized in areas where there is no access provided for this heavy machinery.

U.S. Pat. No. 5,707,180 discloses another apparatus wherein the piling is rotated manually. However, in hard ground surfaces this requires a lot of force by the user and accordingly the use of such screw pilings is restricted to loose soil. Another disadvantage of known screw piling systems is that they require at least three people to operate and it is therefore labour intensive. When a motor is secured to the top of the piling to rotate it, one person is required to stabilize the motor. Another person is necessary to maintain the piling substantially vertically and a third person is required whereby to operate the motor as such pilings are very unstable as they begin to penetrate within the ground surface. These systems are also hazardous to the operators. The installation can also be time-consuming as well as labour intensive and therefore this method is very costly. Known devices are also not ergonomically designed and are bulky and heavy, a further reason why they are labour intensive and difficult to use in remote hard-to-reach areas.

SUMMARY OF INVENTION

It is a feature of the present invention to provide a rotational drive apparatus for screw pilings which substantially overcomes the above disadvantages of the known prior art.

Another feature of the present invention is to provide a rotational drive apparatus which is adapted for use in location with difficult access such as in bushes or backyards of residential area or in areas remote from roads.

Another feature of the present invention is to provide a rotational drive apparatus for screw pilings and which can be utilized by only two operating persons and which does not require any heavy machinery which may be damaging to the environment or to a grassed-in area such as in residential areas.

Another feature of the present invention is to provide a rotation drive apparatus for screw pilings and which is capable of imparting a rotational drive to such pilings in shallow bodies of water and in the interior of structures where a support piling needs to be installed.

Another feature of the present invention is to provide a rotational drive apparatus for screw pilings which is light-weight and easily transportable and which provides sufficient torque to drive the pilings within the earth.

Another feature of the present invention is to provide a drive apparatus for screw pilings which may be used in ecological areas to drive pilings into a swamp area while preserving the environment as the apparatus does not use toxic matter and is non-polluting.

Another feature of the present invention is that the rotational drive apparatus can be used in areas with limited headroom for the reason that the drive apparatus is not connected at the top of the pilings and can be adapted to shorter, interconnectable, piling sections.

Another feature of the present invention is to provide a rotational drive apparatus for screw pilings and wherein the apparatus can be used in harsh climatic conditions such as for driving pilings through snow covered earth.

Another feature of the present invention is to provide a rotational drive apparatus for screw pilings and which apparatus is economical to produce thereby reducing the cost of installation of such pilings and wherein the drive is automatically controlled by a user person and further wherein the drive is adapted to install screw pilings within a ground surface or remove them therefrom.

According to the above features, from a broad aspect, the present invention provides a rotational drive apparatus for earth screw pilings. The apparatus comprises a housing having a cylindrical pipe coupling adapted to receive a shaft of a screw piling therethrough. Detachable connecting means are provided for securing the coupling to the shaft at different positions along the shaft. A rotational drive is provided within the housing for imparting rotation to the coupling. Immobilizing means is provided to maintain the housing substantially stationary whereby to permit the rotational drive to transmit a rotational drive force to the coupling.

According to a still further broad aspect of the present invention there is provided in combination, an earth screw piling having a shaft with a drive helix at a lower end thereof, and a rotational drive apparatus. The shaft has a plurality of spaced-apart holes therealong and extending diametrically across the shaft. The rotational drive apparatus has a cylindrical pipe coupling secured to a selected one of the holes by a pin connector. Means is provided to impart a rotational drive to the shaft coupling for rotating the shaft. Means is provided to immobilize the pipe coupling relative to the shaft when the shaft is rotated.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
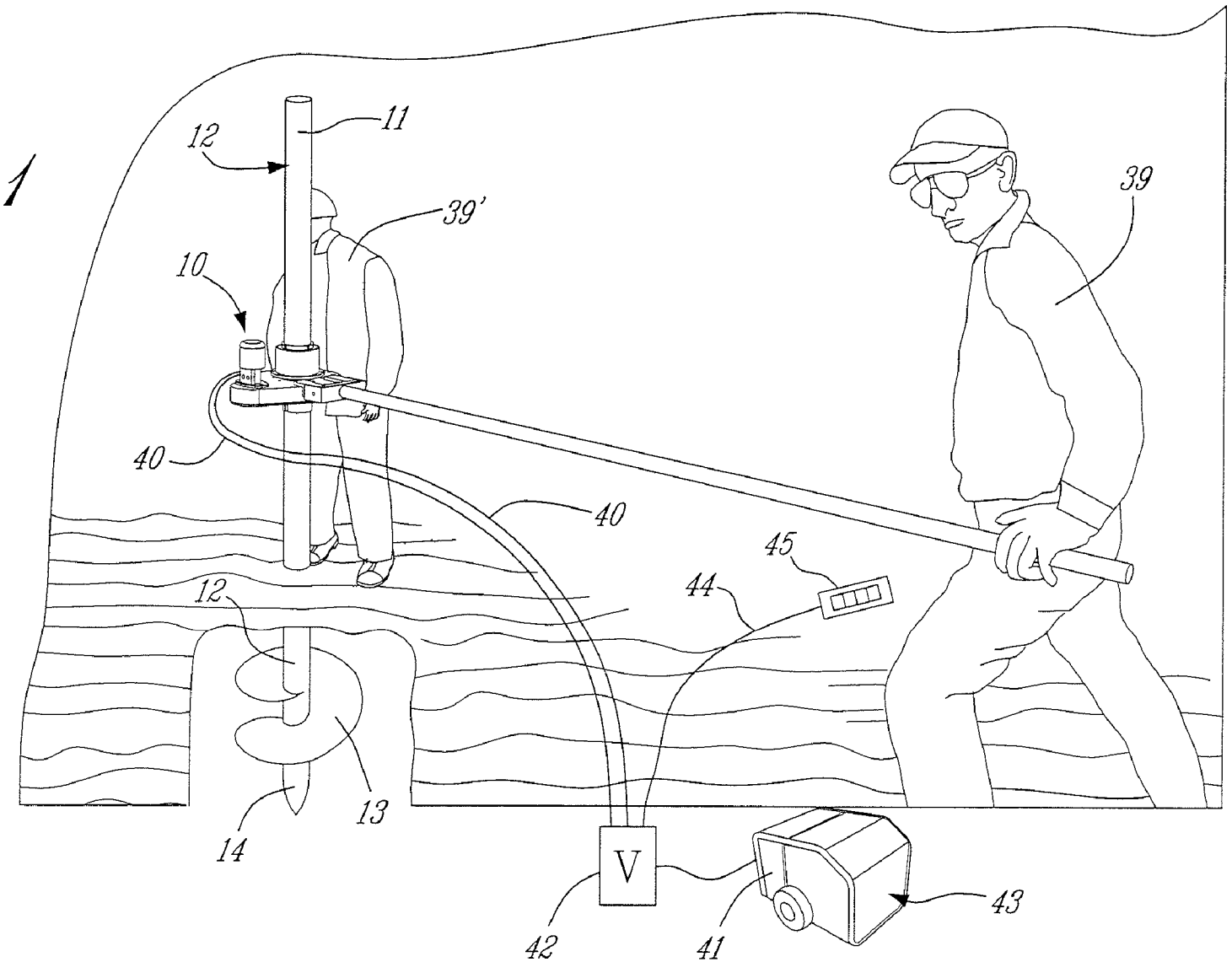
FIG. 1 is a perspective view showing the operation of the rotational drive apparatus for driving a screw piling within a ground surface.
Figure 2:
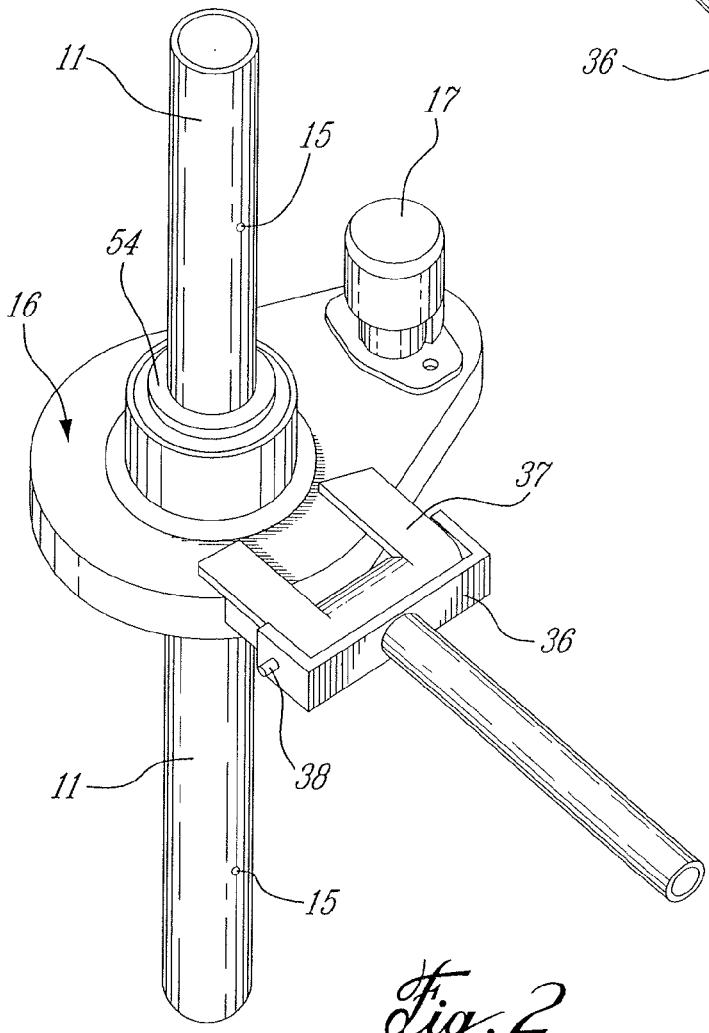
FIG. 2 is a perspective view showing the rotational drive apparatus connected to the shaft of a screw piling.

Referring now to the drawings there will be described the rotational drive apparatus of the present invention. As shown in FIG. 1, the rotational drive apparatus 10 is secured along a shaft 11 of a screw piling 12 which is provided with a drive helix 13 secured at a lower end 14 thereof. The shaft 11 is a hollow shaft as shown in FIG. 2 and is provided with a plurality of spaced-apart holes 15 therealong. The drive apparatus comprises a housing 16 in which is located a drive connection and a coupling to impart rotation to the shaft 11 of the screw piling 12. A drive motor 17 is the power source for the drive.

Figure 4:
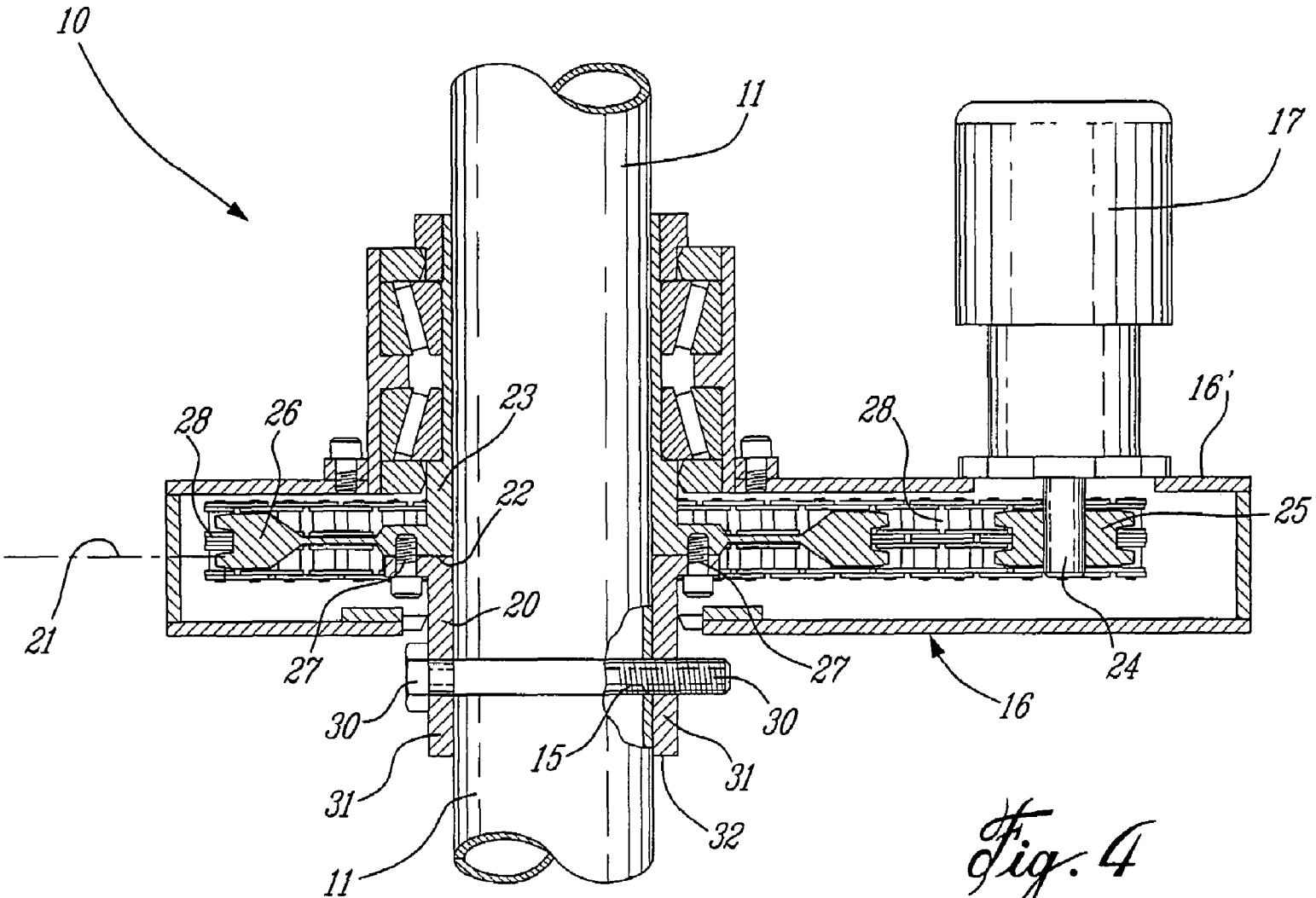
FIG. 4 is a cross-section view through the housing showing the construction of the rotational drive and the coupling of the cylindrical pipe coupling to the shaft of a piling.
Figure 5:
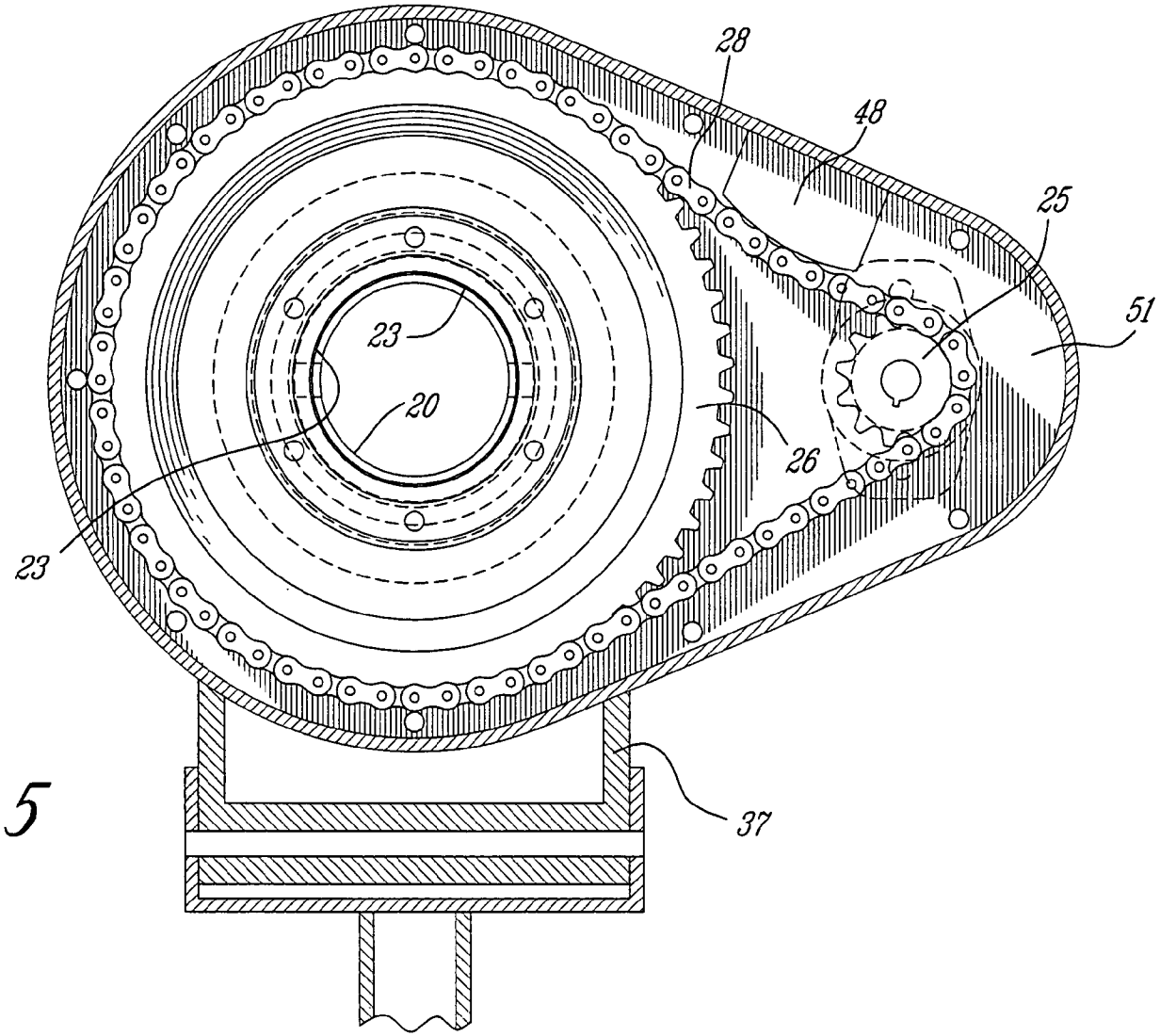
FIG. 5 is a cross-sectional top view illustrating the construction of the rotational drive.
Figure 6:
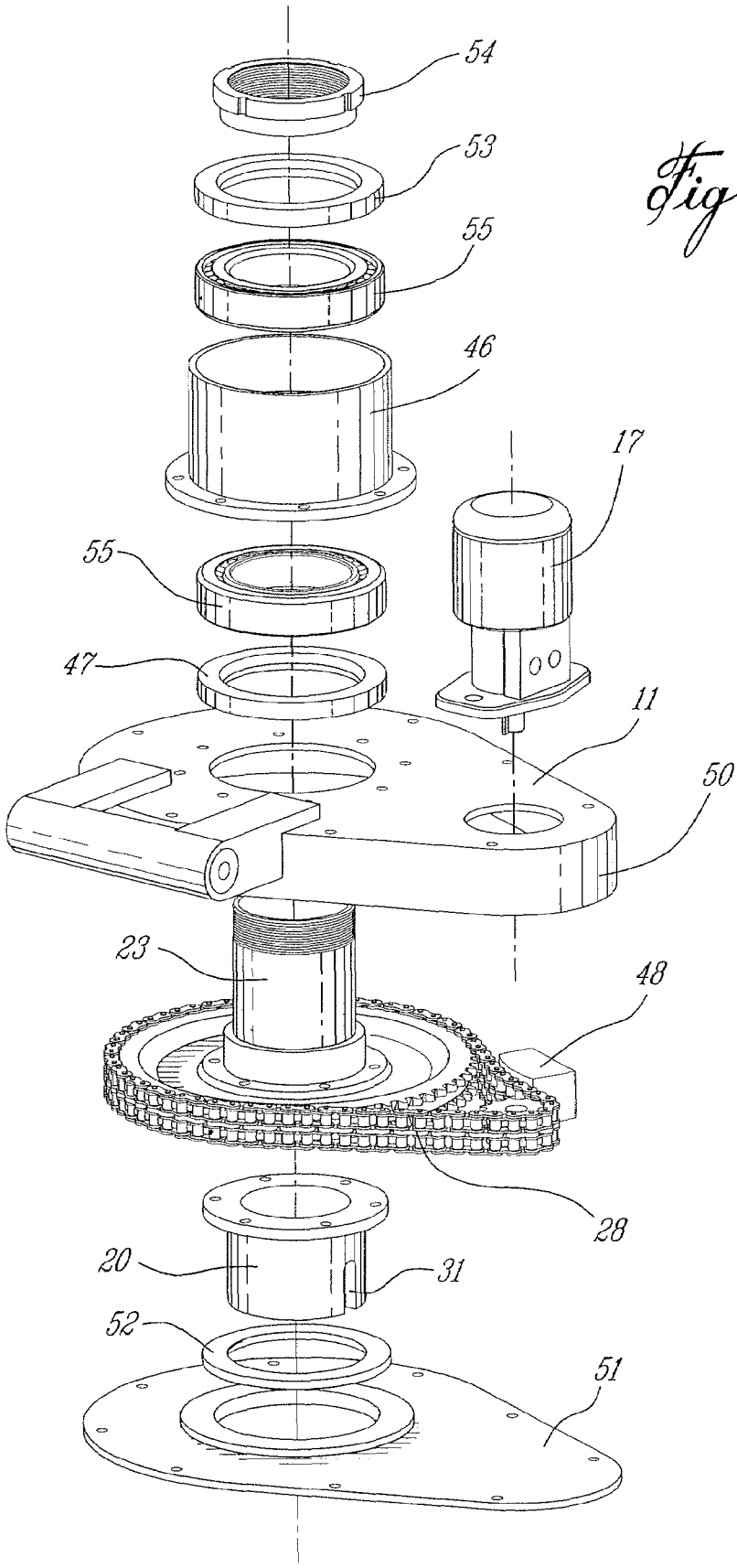
FIG. 6 is an exploded view of the drive housing and its associated parts.

With reference to FIGS. 4, 5 and 6, there is illustrated the construction of the rotational drive component and the shaft coupling. A cylindrical pipe coupling 20 is herein illustrated secured vertically with respect to the horizontal plane 21 of the housing 16. The pipe coupling 20 is secured to the bottom end 22 of a rotational guide sleeve 23 which is dimensioned to receive the shaft 11 of the screw piling in close sliding fit therethrough. The pipe coupling 20 is of substantially like diameter. As hereinshown the coupling and the guide sleeve are of circular cross-section but these can have different cross-sections to match the cross-section of the shaft 11 of the pile to which the-housing is to be secured to.

The drive motor 17 is immovably secured to the top wall 16' of the housing 16 and has a drive shaft 24 extending within the housing and to which is coupled a drive ring gear 25. A driven ring gear 26 is immovably secured to the rotational guide sleeve 23 to which a cylindrical pipe coupling 20 is secured by means of the securing bolts 27. An endless chain 28 interconnects the drive gear 25 to the driven ring gear 26 to impart rotation thereto and to the pipe coupling 20.

In order to couple the cylindrical pipe coupling 20 to the shaft 11 of the screw piling, there is provided a removable lock pin 30. As hereinshown, the cylindrical pipe coupling 20 is provided with diametrically aligned slots 31 projecting vertically from a lower edge 32 thereof with the lock pin being disposed across the slots 31 and through one pair of the diametrically aligned holes 15 of the shaft 11. Accordingly, the shaft is thereby secured to the cylindrical pipe coupling and to the rotational guide sleeve 23.

Figure 3:
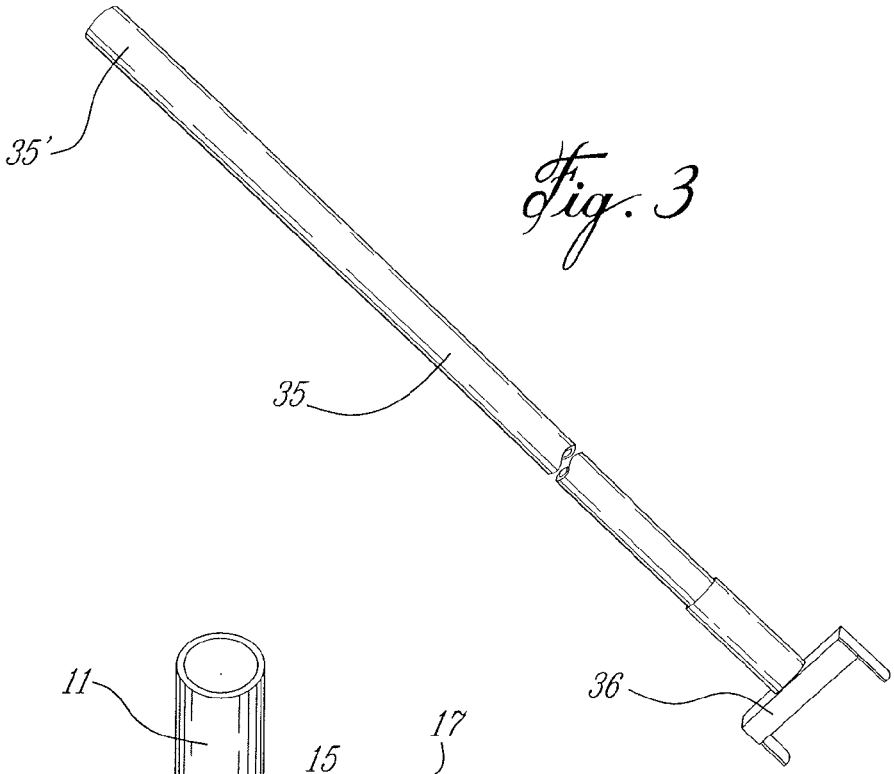
FIG. 3 is a perspective view showing the construction of the elongated immobilizing rod.

In order to cause the cylindrical pipe coupling and the rotational guide sleeve to rotate the shaft 11, it is necessary to immobilize the housing 16. In order to do so, there is provided, as illustrated in FIGS. 1 to 3, an elongated immobilizing rod 35. This rod has an attaching end in the shape of a detachable connecting fork 36 which is secured to a connecting handle 37 secured to the housing 16. The connecting handle provides ease of transportation of the housing. A detachable connecting pin 38 interlocks the elongated rod 35 to the handle 37 and accordingly the housing 16, thereby means for immobilizing the housing during the operation of the rotational drive.

Ideally, the elongated rod 35, as shown in FIG. 1, is long enough to resist the torque of the drive to permit the drive motor 17 to rotate the coupling and provide the necessary torque thereto to drive the piling into the ground. The user person 39 provides this immobilization of the rod 35 and the housing by holding the rod 35 at its far end 35'.

The hydraulic motor 17 as herein-illustrated is a hydraulic drive motor and pressurized hydraulic fluid is supplied thereto through a pair of hoses 40 which are secured to a hydraulic pump 41 through an operable valve 42, as schematically illustrated in FIG. 1. The pressurized reservoir is part of a transportable gas operated hydraulic unit 43. A remote control cable 44 provided with a switching device 45, permits the operator 39 to operate the valve and hence the direction of rotation of the hydraulic motor 17 whereby to screw the piling 12 into the ground or to remove it therefrom. The motor can be rotated in either direction for insertion or removal of the pilings.

As also shown in FIG. 1, the displaceable coupling permits the user persons 39 and 39' to operate the apparatus at a comfortable height, usually between 1 to 4 feet. As the piling screws into the ground and the housing 16 descends closer to the ground, it is only necessary to disconnect the pipe coupling 20 by the removal of the lock pin 30 and to reconnect the housing to the next pair of diametrical holes thereabove. This can be done by a second user person 39' without any assistance due to the compact size and light-weight of the rotational drive apparatus 10.

The earth screw piling as shown in FIG. 1 is usually one which is approximately 10 feet in length but the present invention is not intended to be restricted to such pilings. It is foreseeable that the piling could be of a considerably longer length or the shaft of the piling could be constructed in interconnectable sections. It can be appreciated that the ease of installing the housing 16 to the piling is simple and effortless. With the piling on the ground the shaft of the housing is simply slid through the guide sleeve and pipe coupling which is transversely disposed relative to the housing. The coupling 20, or adaptor, is interchangeable to adapt the piles having different diameter and cross-sectional shapes, such as a square cross-section.

FIG. 6 shows all of the component parts assembly of the rotational drive associated with the housing 16 and they consist of a housing top section 50 and a bottom section 51. Sealing rings 52 and 53 provide the necessary seal to the interior of the housing. A washer 54 is provided at the top end thereof. A pair of roller bearings 55 are secured about the rotational guide sleeve 23 as clearly illustrated in FIG. 4 and located within a bearing housing 46. A sealing ring 47 is also located under the bearing assembly. A chain tensioner 48 is also secured to the inner wall of the top section 50 of the housing 16 to apply tension on the drive chain 28.

The hydraulic unit 43 as herein-illustrated is a two-cylinder 40 horse power gas-operated unit. The reservoir has a capacity of 9.7 liters and the unit weighs about 150 lbs. but is supported on wheels thereby making it easily displaceable. The torquing pressure delivered to the motor is at approximately 140 bar. It is also pointed out that the rotational drive apparatus may be constructed with different types of motors or two motors and of different size whereby to handle earth screw pilings of different sizes and lengths.

It is therefore, within the ambit of the present invention, to cover any obvious modifications of the preferred example of the rotational drive apparatus of the present invention as described herein. However, this is provided such modifications fall within the scope of the appended claims.

I claim:

1. A hand-operable rotational drive apparatus for imparting rotation to a shaft of a single screw piling, said apparatus comprising a housing having a cylindrical pipe coupling adapted to receive said shaft of said screw piling therethrough, said shaft being provided with two or more spaced apart pairs of diametrically aligned holes, said cylindrical pipe coupling being a cylindrical sleeve coupling provided with diametrically aligned slots, a removable connector constituted by a lock pin extending across said diametrically aligned slots in said pipe coupling and a pair of said diametrically aligned holes in said shaft for securing said pipe coupling to said shaft at different positions along said shaft, a rotational drive within said housing for imparting rotation to said coupling when driven by a drive motor immovably secured to said housing, an elongated rod having an attaching end secured directly to said housing with said rod oriented transversely of said shaft, said elongated rod having an opposed end to be grasped by a first user person remotely of said housing to arrest said housing during operation of said rotational drive by said drive motor whereby to permit said rotational drive to transmit a rotational drive force to said coupling to impart said rotation to said shaft, and said drive motor being a hydraulic drive motor, a pair of hydraulic hoses connected to said hydraulic drive motor at one end, said hydraulic hoses being connected at an opposed end to a remote hydraulic pump, and operable valve means to operate said drive motor and control the direction of rotation of said drive motor; said attaching end of said elongated rod having a connecting fork securable to a rod connector, secured to said housing, by a detachable connecting pin and wherein said connecting pin has a longitudinal axis which extends transversely to a longitudinal axis of said shaft.

2. An apparatus as claimed in claim 1 wherein said connecting fork is detachably connected to said housing.

3. An apparatus as claimed in claim 1 wherein said rotational drive comprises a driven ring gear secured about a rotational guide sleeve adapted to receive said shaft of said screw piling in close sliding fit therethrough, a drive ring gear secured to a drive shaft of said drive motor, and coupling means interconnecting said drive shaft to said driven ring gear to impact a rotational drive to said rotational guide sleeve, said cylindrical pipe coupling being removably secured to said rotational guide sleeve.

4. An apparatus as claimed in claim 3 wherein said coupling means is an endless chain interconnecting said drive ring gear to said driven ring gear.

5. An apparatus as claimed in claim 1 wherein said remote hydraulic pump is part of a transportable gas operated hydraulic unit.

6. An apparatus as claimed in claim 5 wherein said valve means is connected to a control cable having a remote switch means for operating said valve means.

7. An apparatus as claimed in claim 1 wherein said rod connector is a transportable handle secured to said housing for ease of transport thereof.

8. An apparatus as claimed in claim 1 wherein said screw piling is an earth screw piling having said shaft with a drive helix at a lower end thereof.

* * * * *